US010679812B2

(12) United States Patent
Tanaka et al.

(10) Patent No.: US 10,679,812 B2
(45) Date of Patent: Jun. 9, 2020

(54) ELECTROMAGNETIC RELAY

(71) Applicant: ANDEN CO., LTD., Anjo, Aichi-pref. (JP)

(72) Inventors: Tomoaki Tanaka, Anjo (JP); Makoto Kamiya, Anjo (JP); Mikihiro Kamiya, Anjo (JP)

(73) Assignee: ANDEN CO., LTD., Anjo, Aichi-pref. (JP)

( * ) Notice: Subject to any disclaimer, the term of this patent is extended or adjusted under 35 U.S.C. 154(b) by 84 days.

(21) Appl. No.: 15/771,344

(22) PCT Filed: Oct. 18, 2016

(86) PCT No.: PCT/JP2016/080761

§ 371 (c)(1),
(2) Date: Apr. 27, 2018

(87) PCT Pub. No.: WO2017/073398

PCT Pub. Date: May 4, 2017

(65) Prior Publication Data

US 2018/0350542 A1 Dec. 6, 2018

(30) Foreign Application Priority Data

Oct. 28, 2015 (JP) ..... 2015-212057

(51) Int. Cl.

| | |
|---|---|
| ***H01H 50/12*** | (2006.01) |
| ***H01H 50/02*** | (2006.01) |
| ***H01H 9/04*** | (2006.01) |
| ***H01H 50/14*** | (2006.01) |
| ***H01H 50/54*** | (2006.01) |
| ***H01H 50/64*** | (2006.01) |

(52) U.S. Cl.

CPC ..... *H01H 50/12* (2013.01); *H01H 9/047* (2013.01); *H01H 50/02* (2013.01); *H01H 50/14* (2013.01); *H01H 50/541* (2013.01); *H01H 50/64* (2013.01)

(58) Field of Classification Search

CPC ..... H01H 50/02; H01H 50/12; H01H 50/14; H01H 50/541; H01H 50/64; H01H 9/047

See application file for complete search history.

(56) References Cited

U.S. PATENT DOCUMENTS 7,843,682 B2 * 11/2010 Leinen ..... H01H 9/047 218/157
9,406,469 B2 * 8/2016 Mimura ..... H01H 50/54

(Continued)

FOREIGN PATENT DOCUMENTS

JP S47012428 Y1 5/1972
JP 54-39537 3/1979

(Continued)

*Primary Examiner* — Bernard Rojas
(74) *Attorney, Agent, or Firm* — Harness, Dickey & Pierce, P.L.C.

(57) ABSTRACT

An electromagnetic relay includes a casing having a housing space open to an external to the casing through an opening. A base is joined to the casing to close the opening. A coil, a pair of fixed contact elements and a pair of movable contact elements are housed in the housing space. A vent hole set to a dimension making it possible to extinguish flame passing therethrough is formed in a portion where the casing and the base are joined together.

3 Claims, 5 Drawing Sheets

(56) References Cited

U.S. PATENT DOCUMENTS

| | | | | |
|---|---|---|---|---|
| 2010/0066471 | A1 | 3/2010 | Nagura et al. | |
| 2010/0193475 | A1* | 8/2010 | Kamiya ..... | H01H 9/04<br>218/157 |

FOREIGN PATENT DOCUMENTS

| | | | |
|---|---|---|---|
| JP | H11145667 | A | 5/1999 |
| JP | 2006059702 | A | 3/2006 |
| JP | 2010092829 | A | 4/2010 |
| JP | 2011192658 | A | 9/2011 |

* cited by examiner

ELECTROMAGNETIC RELAY

CROSS REFERENCE TO RELATED APPLICATIONS

This application is a U.S. National Phase Application under 35 U.S.C. 371 of International Application No. PCT/JP2016/080761 filed on Oct. 18, 2016 and published in Japanese as WO 2017/073398 A1 on May 4, 2017. This application is based on and claims the benefit of priority from Japanese Patent Application No. 2015-212057 filed on Oct. 28, 2015. The entire disclosures of all of the above applications are incorporated herein by reference.

TECHNICAL FIELD

The present disclosure relates to an electromagnetic relay which opens or closes an electric circuit.

BACKGROUND ART

A conventional electromagnetic relay includes a casing having a housing space open to an external through an opening, and a base attached to the casing to close the opening. The housing space communicates with the external through a vent hole formed on the base.

The base has a terminal insertion hole into which a terminal is inserted. The terminal insertion hole and the vent hole are next to each other to communicate with each other. Thus, when flame generated inside the housing space passes through the vent hole, the base and the terminal extinguish the flame by drawing heat from the flame (refer to Patent Literature 1, for example).

PRIOR ART LITERATURE

Patent Literature

Patent Literature 1: JP 5131218 B

SUMMARY

However, the conventional electromagnetic relay may have a limitation in position of the vent hole, and a degree of freedom of design may reduce.

The vent hole needs to have a width smaller than a predetermined dimension from a viewpoint of flame extinguishment while the vent hole needs to ensure a predetermined passage area, i.e. predetermined width and length, from a viewpoint of air passing therethrough.

However, when the vent hole is formed next to the terminal insertion hole as in the conventional electromagnetic relay, the length of the vent hole is affected by a longitudinal dimension of the terminal insertion hole and a width dimension of the terminal. Therefore, when a width of the terminal is small, and a width of the vent hole is set to be smaller than or equal to the predetermined dimension for flame extinguishment, the predetermined passage area of the vent hole is difficult to be ensured.

Further, in the conventional electromagnetic relay, the housing space communicates with the external only through the vent hole. Hence, air tightness at a portion where the casing and the base are joined together needs to be ensured by the casing and the base adhering and being fixed to each other.

In view of the above points, a first object of the present disclosure is to enhance the degree of freedom of design. A second object is to ensure the predetermined passage area while keeping a flame-extinguishing function.

According to a first aspect of the present disclosure, an electromagnetic relay includes: a casing having a housing space open through an opening to an external to the casing; a base joined to the casing to close the opening; a coil disposed in the housing space to generate an electromagnetic force upon an energization of the coil; a pair of fixed contact elements fixed to the base and having an end disposed in the housing space; a movable contact element disposed in the housing space and driven by the electromagnetic force generated by the coil to contact or separate from the fixed contact elements; and a vent hole through which the housing space communicate with the external, the vent hole being set to a dimension making it possible to extinguish flame passing through the vent hole. The vent hole is formed in a portion where the casing and the base are joined together.

Accordingly, the position of the vent hole can be set without being restricted by a position of a terminal insertion hole. The degree of freedom of design is thereby enhanced.

Since the dimension of the vent hole can be set without being affected by a width dimension of a terminal, it is easier to ensure a flame-extinguishing function and ensure a predetermined passage area.

Further, since it is unnecessary to ensure air tightness in the portion where the casing and the base joined together, the casing and the base can be joined by a method other than adhesion.

In the electromagnetic relay of the above-described first aspect, a protrusion may be provided on one of the casing or the base, and a tip end of the protrusion may contact another of the casing or the base to form the vent hole.

According to a second aspect of the present disclosure, an electromagnetic relay includes: a casing having a housing space open through an opening to an external to the casing; a base joined to the casing to close the opening; a coil disposed in the housing space to generate an electromagnetic force upon an energization of the coil; a pair of fixed contact elements fixed to the base and having an end disposed in the housing space; a movable contact element disposed in the housing space and driven by the electromagnetic force generated by the coil to contact or separate from the fixed contact elements; and a vent hole through which the housing space communicate with the external, the vent hole being set to a dimension making it possible to extinguish flame passing through the vent hole. The vent hole is formed on the casing.

According to a third aspect of the present disclosure, an electromagnetic relay includes: a casing having a housing space open through an opening to an external to the casing; a coil disposed in the housing space to generate an electromagnetic force upon an energization of the coil; a coil terminal whose end is connected to the coil while another end protrudes to the external; a base joined to the casing to close the opening, the base having a terminal insertion hole through which the coil terminal extends; a pair of fixed contact elements fixed to the base and having an end disposed in the housing space; a movable contact element disposed in the housing space and driven by the electromagnetic force generated by the coil to contact or separate from the fixed contact elements; and a vent hole through which the housing space communicate with the external, the vent hole being set to a dimension making it possible to extinguish flame passing through the vent hole. The vent hole is formed on the base without communicating with the terminal insertion hole.

Accordingly, the position of the vent hole can be set without being restricted by a position of the terminal insertion hole. The degree of freedom of design is thereby enhanced.

Since the dimension of the vent hole can be set without being affected by a width dimension of a terminal, it is easier to ensure a flame-extinguishing function and ensure a predetermined passage area.

DESCRIPTION OF EMBODIMENTS

Figure 1:
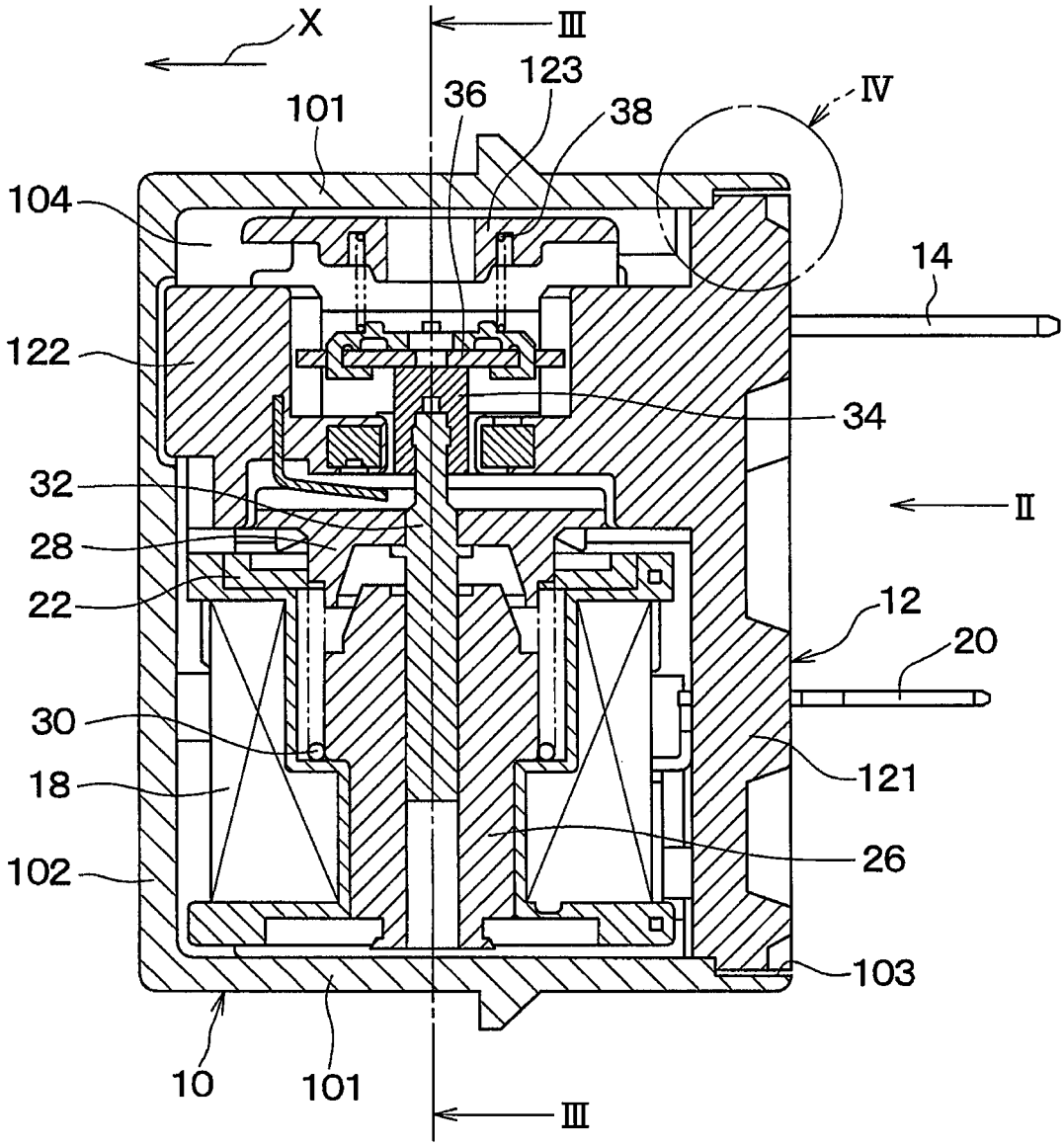
FIG. 1 is a cross-sectional view illustrating an electromagnetic relay according to a first embodiment of the present disclosure.

Hereinafter, multiple embodiments for implementing the present disclosure will be described referring to drawings. In the respective embodiments, a part that corresponds to a matter described in a preceding embodiment may be assigned the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

An electromagnetic relay according to a present embodiment can be used for an electric vehicle on which a fuel cell is mounted. The fuel cell utilizes hydrogen gas which is one of flammable gas.

Figure 2:
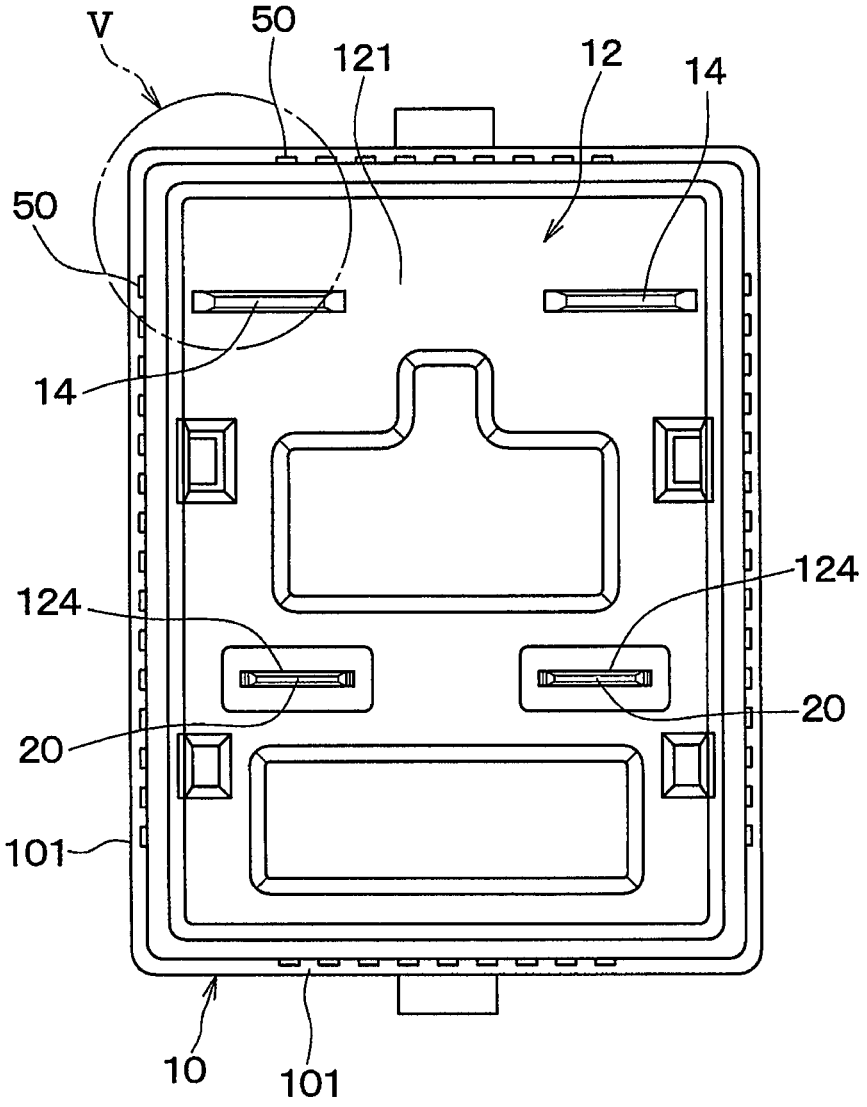
FIG. 2 is a view from an arrow II of FIG. 1.
Figure 3:
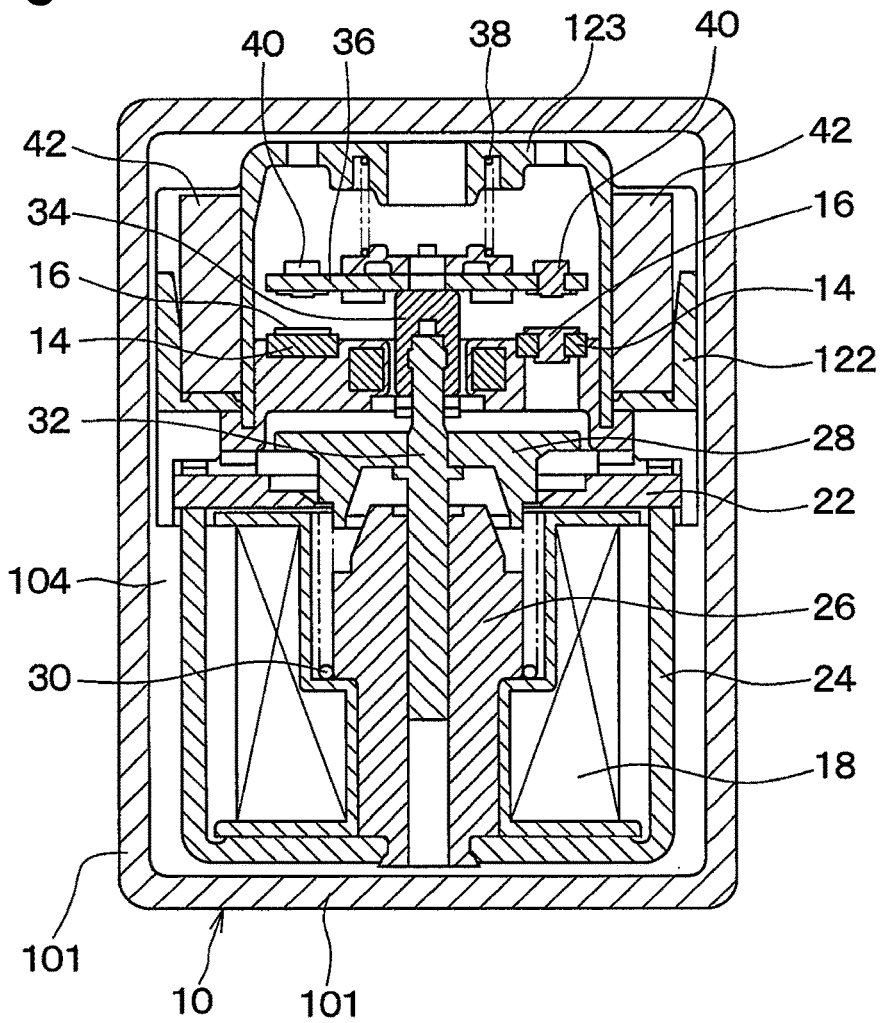
FIG. 3 is a cross-sectional view taken along a line III-Ill of FIG. 1.

As shown in FIGS. 1 to 3, the electromagnetic relay of the present embodiment includes a casing 10 made of resin. The casing 10 includes four casing side walls 101 and one casing bottom 102. The casing 10 has a casing opening 103 on a side of the casing 10 facing the casing bottom 102. The casing 10 has a bottomed rectangular cylindrical shape. A housing space 104 is provided inside the casing 10, and the housing space 104 is open through the casing opening 103 to an external to the casing 10.

A base 12 made of resin includes a base bottom 121 joined to the casing 10 to close the casing opening 103, a base body 122 protruding from the base bottom 121 toward the casing bottom 102, and a base spring support 123 supporting a pressing spring 38 described later. The housing space 104 is defined by the casing 10 and the base bottom 121. The base 12 is obtained by insert-molding with a pair of fixed elements 14 as inserted objects.

The base bottom 121 includes two terminal insertion holes 124 through which a pair of coil terminals 20 described later is inserted.

When the base 12 is attached to the casing 10, the base 12 is inserted into the casing 10 by the base 12 being moved relative to the casing 10 from a right side to a left side on the paper of FIG. 1 as shown by an arrow X. Hereinafter, an inserting direction of the base 12 at a time of attaching the base 12 to the casing 10 is referred to as a base insertion direction X. The casing 10 and the base 12 are joined together by a non-shown snap-fitting feature.

The pair of fixed elements 14 made of conductive metallic plates is fixed to the base 12. An end of each fixed element 14 is fixed to the base body 122 and positioned in the housing space 104, and another end of the fixed element 14 protrudes to the external. An end portion of the fixed element 14 in the housing space 104 is fixed to a fixed contact 16 made of a conductive metal by crimping. Another end portion of the fixed element 14 in an external space is connected to an external electric circuit (not shown). The fixed element 14 and the fixed contact 16 may be an example of a pair of fixed contact elements whose end is disposed in the housing space 104 and fixed to the base 12.

A coil 18 having a circular cylindrical shape is disposed in the housing space 104 and generates an electromagnetic force upon an energization of the coil 18. The coil 18 is connected to a pair of coil terminals 20 made of a conductive metal.

Each coil terminal 20 is inserted into the corresponding terminal insertion hole 124 such that an end of the coil terminal 20 extends outward of the electromagnetic relay. More specifically, the coil terminal 20 is press-fitted into the terminal insertion hole 124. There is no clearance between the coil terminal 20 and an inner wall defining the terminal insertion hole 124. The coil terminal 20 is connected to an ECU (not shown) through an external harness. Electricity is supplied to the coil 18 through the external harness and the coil terminal 20.

A plate 22, having a circular plate shape and made of a ferromagnetic metal, is disposed between the coil 18 and the base body 122. A yoke 24 made of a ferromagnetic metal disposed on a side of the coil 18 facing away from the base body 122 and on a side of the coil 18 facing radially outward. The plate 22 and the yoke 24 are fixed to the base 12.

A fixed core 26, having a circular cylindrical shape and made of a ferromagnetic metal, is disposed in a radially inner space of the coil 18. The fixed core 26 is supported by the yoke 24.

A movable core 28, having a circular plate shape and made of a ferromagnetic metal, is disposed between the base body 122 and the plate 22. A return spring 30 is disposed between the coil 18 and the movable core 28 and urges the movable core 28 away from the fixed core 26.

When the coil 18 is energized, the movable core 28 is attracted toward the fixed core 26 against an urging force of the return spring 30 by an electromagnetic force generated by the coil 18. The plate 22, the yoke 24, the fixed core 26 and the movable core 28 constitute a magnetic path for a magnetic flux induced by the coil 18.

A shaft 32 made of a metal extends through the movable core 28 and is fixed to the movable core 28. An end of the shaft 32 extends away from the fixed core 26 and is fitted and fixed to an insulator 34 which is made of a resin having a high insulating ability. Another end of the shaft 32 is slidably inserted into the fixed core 26.

A movable element 36 made of a conductive metallic plate is housed in the housing space 104. The pressing spring 38 is disposed between the movable element 36 and the base spring support 123 and urges the movable element 36 toward the insulator 34. The movable element 36 is provided with two movable contacts 40 which are made of a conductive metal and crimped and fixed at positions corresponding to the two fixed contacts 16. The movable elements 36 and the movable contacts 40 may be example of a movable contact element disposed in the housing space 104 and driven by the electromagnetic force generated by the coil 18 to contact or separate from the fixed contact elements.

A pair of permanent magnets 42 is disposed in a recess of the base body 122. The permanent magnets 42 generate magnetic fields in contact-separation areas where the fixed contacts 16 and the movable contacts 40 contact or separate from each other, thereby stretching an electric arc generated between the fixed contacts 16 and the movable contacts 40. These permanent magnets 42 are arranged to face each other in a direction along which the pair of contact-separation areas are aliened (i.e. a right-left direction on the paper of FIG. 3).

Multiple vent holes 50 are formed in a portion where the casing 10 and the base bottom 121 are joined together. The housing space 104 communicates with an external to the electromagnetic relay through the vent holes 50.

Figure 4:
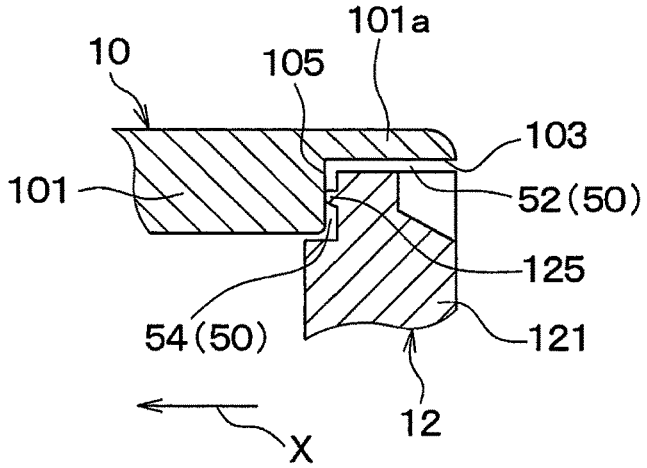
FIG. 4 is an enlarged cross-sectional view illustrating a part IV of FIG. 1.
Figure 5:
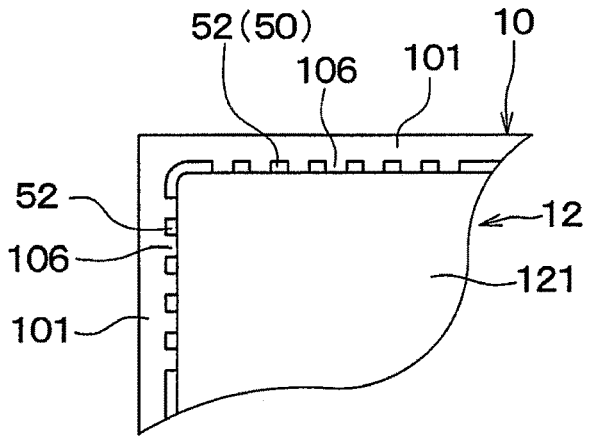
FIG. 5 is an enlarged view illustrating a part V of FIG. 2.

Hereinafter, the vent holes 50 will be described with reference to FIGS. 4 and 5.

An inner wall surface of the casing side wall 101 has a casing receiving surface 105 which is perpendicular to the base insertion direction X. The casing receiving surface 105 is formed on each of the four casing side walls 101.

A thickness of a part of the casing side wall 101 between the casing receiving surface 105 and the casing opening 103 is thinner than a thickness of a part of the casing side wall 101 between the casing receiving surface 105 and the casing bottom 102. Hereinafter, the thinner part of the casing side wall 101 between the casing receiving surface 105 and the casing opening 103 is referred to as a casing thin wall part 101*a*.

Multiple casing protrusions 106 protrude from an inner wall surface of the casing thin wall part 101*a* toward the base bottom 121 in a direction perpendicular to the base insertion direction X. The casing protrusions 106 are provided to each of the four casing thin wall parts 101*a*.

Multiple base protrusions 125 are provided adjacent to an outer circumferential edge of the base bottom 121 and protrude from a surface of the base bottom 121 facing the housing space 104 toward the casing receiving surface 105 in the base insertion direction X.

When the casing 10 and the base 12 are joined to each other, tip ends of the casing protrusions 106 are in contact with an outer circumferential surface of the base bottom 121, i.e. a surface of the base bottom 121 facing the casing thin wall part 101*a*. Accordingly, first gaps 52 are formed between the casing thin wall part 101*a* and the outer circumferential surface of the base bottom 121.

When the casing 10 and the base 12 are joined to each other, tip ends of the base protrusions 125 are in contact with the casing receiving surface 105. Accordingly, second gaps 54 are formed between the casing receiving surface 105 and the surface of the base bottom 121 facing the housing space 104. The first gaps 52 and the second gaps 54 constitute the vent holes 50.

The sizes of the first gaps 52 and the sizes of the second gaps 54 are set to a dimension making it possible to extinguish flame passing therethrough. More specifically, when flammable gas flowing into the housing space 104 is hydrogen gas, the sizes of the first gaps 52 and the sizes of the second gaps 54 are set at 0.3 mm or less.

Next, an operation of the electromagnetic relay of the present embodiment will be described. First, when the coil 18 is energized, the movable core 28 is attracted toward the fixed core 26 by the electromagnetic force against the urging force of the return spring 30. The movable element 36 is urged by the pressing spring 38 and follows the movable core 28. Accordingly, the two movable contacts 40 contact the two fixed contacts 16, and continuity is established between the pair of fixed elements 14.

When the energization of the coil 18 is terminated, the movable core 28 and the movable element 36 are urged by the return spring 30 against the urging force of the pressing spring 38. Accordingly, the two movable contacts 40 are separated from the two fixed contacts 16, and the continuity between the pair of fixed elements 14 is interrupted.

Under environment where flammable gas exists around the electromagnetic relay, the flammable gas may flow into the housing space 104 through the vent holes 50. The flammable gas in the housing space 104 may be ignited by an electric arc generated between the fixed contacts 16 and the movable contacts 40.

When flame caused by the electric arc through ignition of the flammable gas passes through the vent holes 50 (i.e. the first gaps 52 and the second gaps 54), heat of the flame is drawn by the casing 10 and the base 12. Thus, the flame cannot be kept and extinguished. Therefore, the flame caused by the electric arc through ignition of the flammable gas can be prevented from being transferred outward of the electromagnetic relay, and ignition of flammable gas existing around the electromagnetic relay can be prevented.

According to the present embodiment, the positions of the vent holes 50 can be set without being restricted by the positions of the terminal insertion holes 124. The degree of freedom of design is thereby enhanced.

Further, the dimension of the vent holes 50 can be set without being affected by a width dimension of the coil terminal 20. Thus, it is easier to ensure a flame-extinguishing function and ensure a predetermined passage area.

Furthermore, it is unnecessary to keep air tightness in the portion where the casing 10 and the base 12 are joined together. Thus, the casing 10 and the base 12 can be joined by a method other than adhesion.

Figure 6:
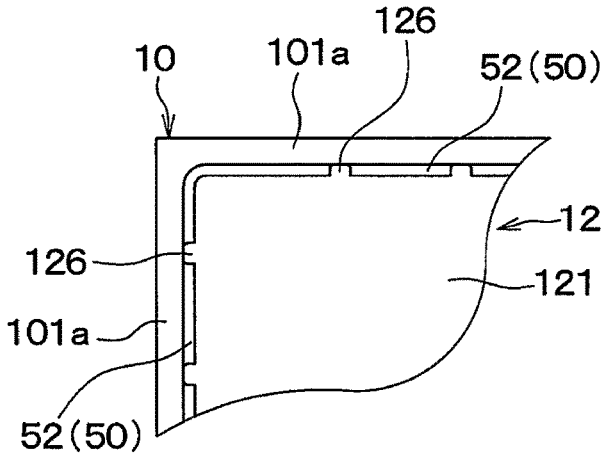
FIG. 6 is a view illustrating an electromagnetic relay according to a modification of the first embodiment of the present disclosure.

In the above-described embodiment, the first gaps 52 are formed by providing the casing protrusions 106 to the casing 10. Alternatively, as in a modification shown in FIG. 6, second base protrusions 126 may be provided on the outer circumferential surface of the base bottom 121, and tip ends of the second base protrusions 126 may contact the casing thin wall part 101*a*, thereby providing the first gaps 52.

In the above-described embodiment, the second gaps 54 are formed by providing the base protrusions 125 to the base 12. Alternatively, second casing protrusions may be provided on the casing receiving surface 105, and tip ends of the second casing protrusions may contact the surface of the base bottom 121 facing the housing space 104, thereby providing the second gaps 54.

Second Embodiment

A second embodiment will be described with reference to FIG. 7. In the present embodiment, the positions of the vent holes 50 are different from those of the first embodiment. In the present embodiment, explanations of portions similar or equivalent to portions of the first embodiment will be omitted or simplified.

Figure 7:
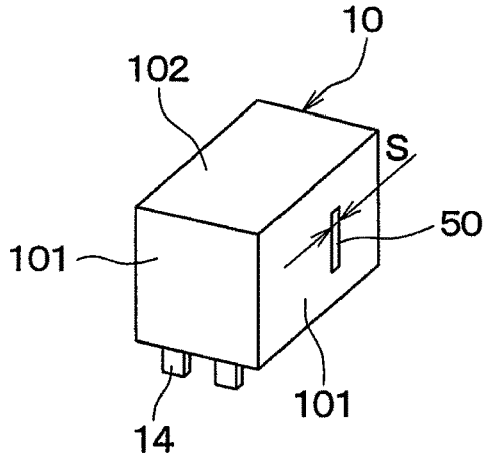
FIG. 7 is a perspective view illustrating an electromagnetic relay according to a second embodiment of the present disclosure.

As shown in FIG. 7, in the present embodiment, a vent hole 50 is provided on a single casing 10, through which a housing space 104 (refer to FIG. 1) communicates with an external. More specifically, the vent hole 50 is a rectangular elongated slit extending through a casing side wall 101. A dimension S of a short side of the vent hole 50 is set to a dimension making it possible to extinguish flame passing therethrough.

When flame caused by an electric arc through ignition of flammable gas passes through the vent hole 50, heat of the flame is drawn by the casing 10, and the flame cannot be kept and extinguished.

According to the present embodiment, a position of the vent hole 50 can be set without being restricted by a position of a terminal insertion hole 124 (refer to FIG. 2). The degree of freedom of design is thereby enhanced.

Further, the dimension of the vent hole 50 can be set without being affected by a width dimension of a coil terminal 20 (refer to FIG. 2). Thus, it is easier to ensure a flame-extinguishing function and ensure a predetermined passage area.

Figure 8:
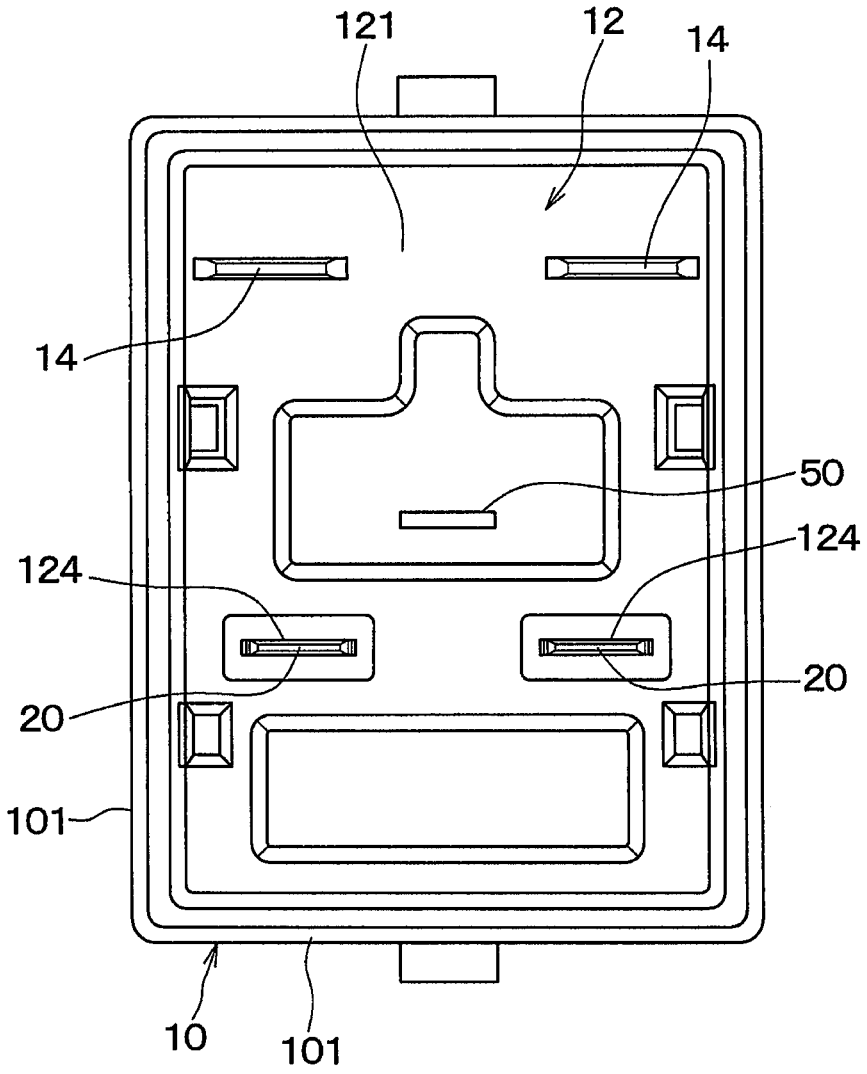
FIG. 8 is a view illustrating an electromagnetic relay according to a modification of the second embodiment of the present disclosure.

In the above-described second embodiment, the vent hole 50 is provided to the casing 10. Alternatively, as shown in FIG. 8, the vent holes 50 may be provided on the base bottom 121 without communicating with the terminal insertion hole 124.

In the above-described embodiments, the casing 10 is made of a resin, but the casing 10 may be made of a metal. In the above-described embodiments, the base 12 is made of a resin, but the base 12 may be made of a ceramic.

The present disclosure is not limited to the above-described embodiments, and may be arbitrarily modified within the scope described in claims.

The above-described embodiments are related to each other, and may be arbitrarily combined with each other unless such combination is clearly impossible.

In each of the above-described embodiments, it is needless to say that elements constituting the embodiment are not necessarily essential unless the elements are clearly specified as especially essential or considered as obviously essential in principle.

In each of the above-described embodiments, when a numeral such as the number, value, amount, or range of a constituent of the embodiment is described, it is not limited to the specific numeral unless the specific numeral is clearly specified as especially essential or it is obvious to limit to the specific numeral in principle.

In each of the above-described embodiments, when a shape, positional relationship or the like of a constituent is described, it is not limited to the specific shape, positional relationship or the like unless the specific shape or positional relationship is especially specified or it is obvious to limit to the specific shape or positional relationship.

While the present disclosure has been described with reference to embodiments thereof, it is to be understood that the disclosure is not limited to the embodiments and constructions. To the contrary, the present disclosure is intended to cover various modification and equivalent arrangements. In addition, while the various elements are shown in various combinations and configurations, which are exemplary, other combinations and configurations, including more, less or only a single element, are also within the spirit and scope of the present disclosure.

What is claimed is:

1. An electromagnetic relay comprising:

a casing having a housing space open through an opening to an external to the casing;

a base joined to the casing to close the opening;

a coil disposed in the housing space to generate an electromagnetic force upon an energization of the coil;

a pair of fixed contact elements fixed to the base and having an end disposed in the housing space;

a movable contact element disposed in the housing space and driven by the electromagnetic force generated by the coil to contact or separate from the fixed contact elements; and a plurality of vent holes through which the housing space communicate with the external, the vent hole being set to a dimension making it possible to extinguish flame passing through the vent hole, wherein the plurality of vent holes are arranged in a portion where the casing and the base are joined together, and one of the casing and the base has a plurality of protrusions having tip ends contacting another of the casing and the base such that the plurality of protrusions define the plurality of vent holes between the casing and the base.

2. The electromagnetic relay according to claim 1, wherein the base includes a base bottom fitted to a casing wall of the casing that defines the housing space, and a base body extending from the base bottom into the housing space in a base insertion direction, the casing wall includes a casing receiving surface that is perpendicular to the base insertion direction and faces the base bottom, the casing wall includes a thin wall part and a thick wall part such that the thin wall part is located between the thick wall part and the base bottom in the base insertion direction, an inner surface of the thin wall part is recessed from an inner surface of the thick wall part such that the casing receiving surface is between the thin wall part and the thick wall part, and the plurality of protrusions are provided on one of the casing receiving surface of the casing and the base bottom and protrude in the base insertion direction.

3. The electromagnetic relay according to claim 2, wherein the plurality of protrusions are also provided on one of the inner surface of the thin wall part and the base bottom and protrude in a direction perpendicular to the base insertion direction.

* * * * *